United States Patent [19]

Karlsson et al.

[11] 4,021,011

[45] May 3, 1977

[54] DEVICE FOR ATTACHING A SCAFFOLDING BRACKET TO A VERTICAL WALL SURFACE

[75] Inventors: Kurt Karlsson, Kungsbacka; Thorsten Lundberg, Askim, both of Sweden

[73] Assignee: AB Gotaverken, Sweden

[22] Filed: Nov. 25, 1975

[21] Appl. No.: 635,102

[30] Foreign Application Priority Data

Dec. 27, 1974 Sweden ..... 7416294

[52] U.S. Cl. ..... 248/235

[51] Int. Cl.[2] ..... A46G 29/02

[58] Field of Search ..... 248/235, 239, 240, 240.3, 248/240.4; 85/1 K, 1 H, 1

[56] References Cited

UNITED STATES PATENTS

| | | | |
|---|---|---|---|
| 365,830 | 7/1887 | Locke | 248/235 |
| 511,625 | 12/1893 | Kenison et al. | 248/235 |
| 788,899 | 5/1905 | Grieves et al. | 248/235 |
| 1,210,595 | 1/1917 | Brubaker | 85/1 H |
| 1,577,193 | 3/1926 | Reed | 85/1 H |
| 2,249,403 | 7/1941 | Stollsteimer | 248/240.3 |
| 2,388,658 | 11/1945 | Pumphrey | 85/1 |
| 2,395,377 | 2/1946 | MacLean | 85/1 K |
| 3,292,480 | 12/1966 | Vozumi | 85/8.1 |
| 3,664,434 | 5/1972 | Connor et al. | 85/1 H |

*Primary Examiner*—Robert A. Hafer

[57] ABSTRACT

In the shipbuilding industry a number of temporarily erected scaffolds are needed and these scaffolds are carried by brackets mounted at various ship's structures, said structures usually being provided with permanently attached fittings for this purpose; certain internal components of a ship are provided with apertures without impairing their strength, which makes possible a very easy mounting of scaffolding brackets; the apertures are formed as horizontally running slots, and an attaching member at the bracket is formed as a flattened bolt head arranged vertically; when mounting a bracket, this is rotated 90° in relation to its working position, whereby the flattened head will be oriented horizontally and can be inserted through the aperture; upon rotation of the bracket back to its working position, the head will engage the back face of the wall and the bolt may be tightened.

4 Claims, 4 Drawing Figures

DEVICE FOR ATTACHING A SCAFFOLDING BRACKET TO A VERTICAL WALL SURFACE

FIELD OF THE INVENTION

The present invention relates to a device for use with scaffolds utilized for building and repair of ships but which can also be used in connection with vertical working surfaces of arbitrary type.

BACKGROUND OF THE INVENTION

The scaffold comprises a number of platforms which are supported directly or indirectly by brackets. Each one of the brackets is shaped as a cantilever arm arranged for attachment in an elongated slot in the wall surface, or in a mounting thereon, by means of an attaching member at its end facing the wall surface. The attachment of the bracket to the wall surface is carried out in such a way that the free end of the attaching member, which end is elongated in a direction substantially perpendicularly to the arm, is aligned in the longitudinal direction of the slot and inserted therein. Thereafter, the bracket and the attaching member are rotated 90° for obtaining support of the bracket in the slot and abutment against the wall by means of a support member for the cantilevered arm.

The object of the invention is the provision of an easily mountable and dismountable scaffold especially suited for use in ship building, the scaffold being particularly advantageous in that loss of material in the form of separate attaching members, bolts, nuts, etc., is kept at a minimum, when the scaffolds are mounted and dismounted, respectively.

Within the field of ship building large sections are often built outside the mounting place, and when such sections are transported to the mounting place the sections are often turned around. However, it is desirable that at least the brackets for the scaffold are left at the section during the transportation, so the brackets immediately are in the correct positions when the sections are fitted into the hull being built. The bracket according to the invention is constructed for meeting said demand.

SUMMARY OF THE INVENTION

The invention is characterized in that the attaching member comprises a bolt, the head of which being elongated in a direction substantially perpendicularly to the bolt axis, in that the shaft of the bolt is guided by a mounting portion of the bracket in order to prevent relative rotation between the bolt and the bracket, in that an attaching nut is carried by the shaft and is prevented from leave the shaft by means of stop, and in that a notch available from above is provided in the region of the nut in order to allow resetting of the nut. Preferably, the bolt is prevented from rotating relative the mounting portion by making the shaft portion of the bolt engaging the mounting portion square shaped and letting this portion cooperate with a correspondingly shaped slot in the mounting portion.

DESCRIPTION OF SOME PREFERRED EMBODIMENTS

Figures 1, 2:
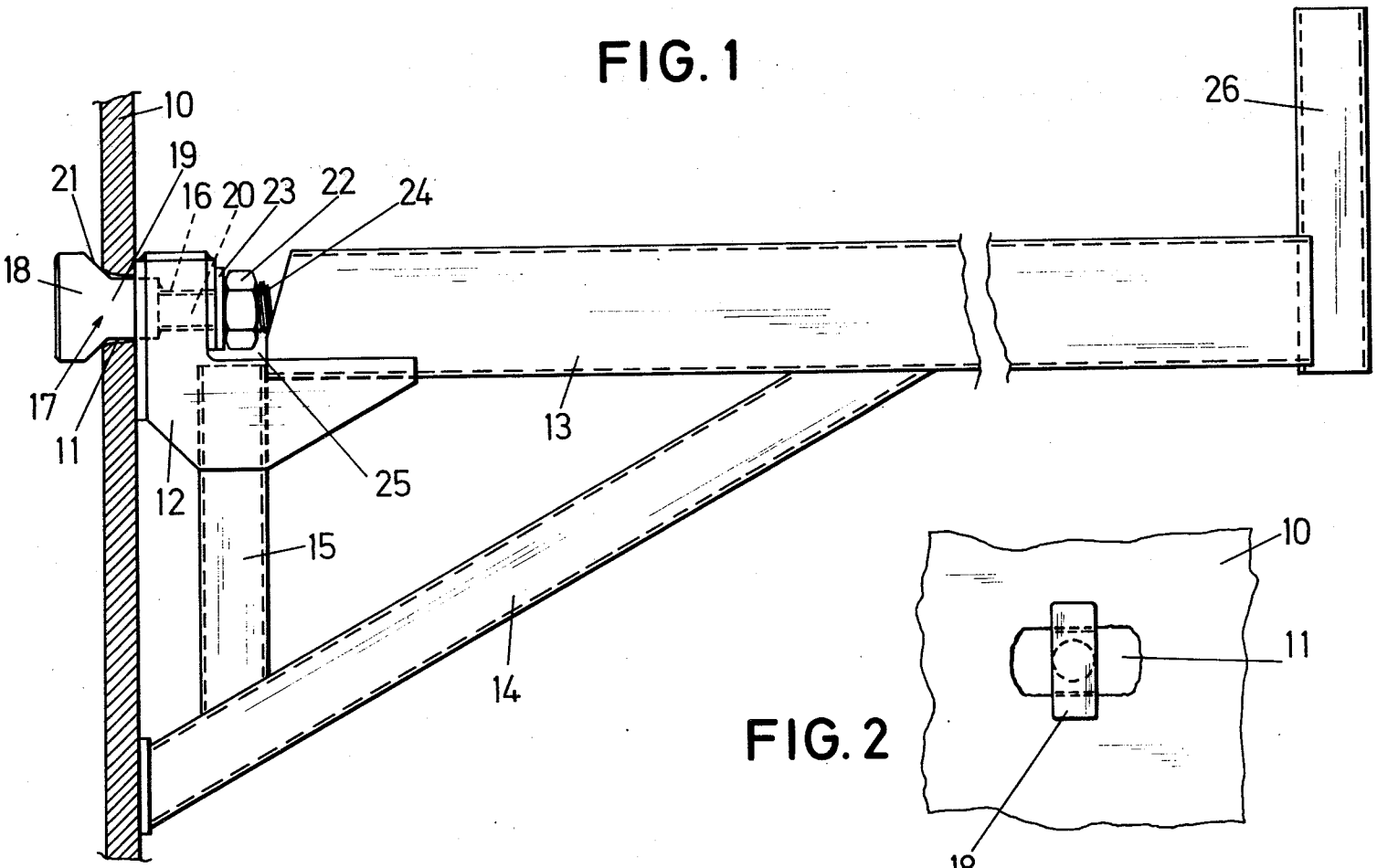
FIG. 1 shows a portion of a wall surface or a portion of a mounting being provided on the wall surface, and a bracket according to the invention being arranged thereon.
FIG. 2 is a partial end view seen from the left in FIG. 1.

A number of horizontally elongated slots 11 are formed in a vertical wall surface 10. On the drawing only one such slot has been shown. The purpose of the slot is to cooperate with a bolt in a mounting portion 12 of a bracket, which according to the embodiment in FIG. 1 comprises a horizontal arm 13, an inclined lower bar 14 connected thereto and a vertical bar 15, which connects the mounting portion 12 and the inclined bar 14. The arm, the bars and the mounting portion are formed of a pipe having substantially quadrangular section. In the mounting portion 12 there is a hole 16 going through said portion, and having a portion with quadrangular section. A bolt 17 is inserted in said hole, and has a portion for locking engagement with the quadrangular portion of the hole. The bolt comprises a head 18, a mid-portion 19 and a shaft 20 extending from said portion. The mid-portion 19 has a dimension substantially corresponding to the section of slot 11. The head 18 which is elongated in a direction perpendicularly to the mid-portion 19 has side surfaces 21 converging towards the mid-portion. Said side surfaces can form part of the envelope surfaces of truncated cones. Furthermore, there is a nut 22 and a washer 23 on the shaft 20 of the bolt. The nut and the washer are kept in place by means of a locking pin 24. The nut and the shaft end of the bolt are accomodated in a notch 25 between the mounting portion 12 and the arm 13.

At the free end thereof the arm of the bracket is provided with an upright pin 26, which acts as support for platforms (not shown) placed on the brackets.

The characterizing feature of the invention is the shape of the bolt, or attaching member 17, and the mounting portion 12 cooperating therewith. Since the bolt and the nut are permanently maintained in the mounting portion the loss of material previously mentioned is avoided, and since the nut is easily available from the above of the bracket, tightening and retightening, respectively, of the bolt can easily be performed.

The mounting of a bracket having an attaching member of the above kind is carried out according to the following. the bracket is so aligned that the longitudinal direction of bolt head 18 coincides with the longitudinal direction of slot 11. The bolt head is inserted through the opening and the bracket and accompanying bolt are rotated 90° so that the bolt head assumes the position relative the opening shown in FIG. 2. Thereafter the nut is tightened so that the converging surfaces 21 abut the border surfaces of the opening. When the brackets and the scaffold supported thereon are to be dismounted this is done step by step in such a way that, seen in the direction of the working platform, the nut of the bracket located at the far end is first loosened, and a rope is attached to the inclined bar 14 whereafter the portion of the working platform supported by the far end bracket is removed by pulling it in a direction towards the rest of the platform where it later on safely can be removed. When the far end of the platform has been removed, the bracket located at the far end can easily be removed by exerting a pull in the rope. This implies that the bracket and accompanying bolt are so rotated that the bolt head is permitted to leave the mounting opening. This is simplified by the bolt head having side surfaces converging towards the opening.

Of course, it is also possible to use mounting slots which are elongated in vertical direction, and in this embodiment of openings the bolt head 18 is rotated 90° from the position in FIG. 1.

Figure 3:
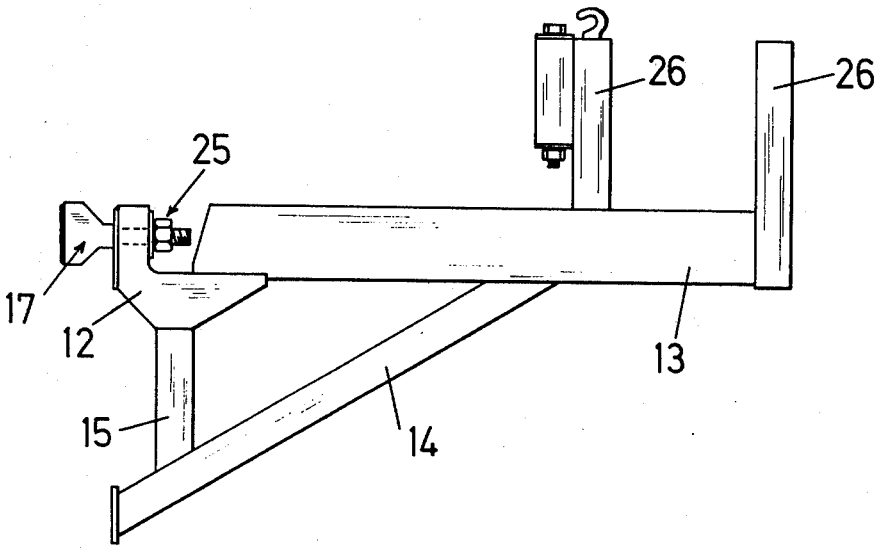
FIG. 3 shows another embodiment of the bracket.

In FIG. 3 there is shown a bracket having two pin shaped elements 26 at the free end of the bracket arm. Brackets of this type are intended for use as support for beams or battens placed edgeways, which act as support for working platforms.

Figure 4:
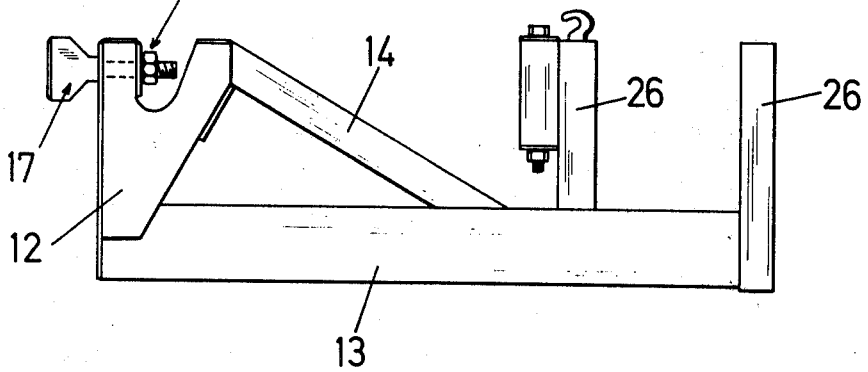
FIG. 4 shows a further embodiment of the bracket.

In FIG. 4 there is shown a modification of the bracket in FIG. 3, and in this embodiment the mounting portion 12 is located at the upper side of the arm 13 and is supported by an inclined bar 14 attached to the upper side of the arm. The notch 25 available from above is here formed in the mounting portion 12. Together with the end of the arm 13 thIs portion acts as the single prevailable support member against the wall surface.

What I claim is:

1. A device for attaching a scaffolding bracket to a vertical wall surface having apertures formed as elongated slots, said bracket comprising a carrying portion including a cantilever arm adapted to carry scaffolding material, the improvement of a mounting portion at the inward end of the bracket, a passage in said mounting portion extending substantially parallel to the direction of said arm, and through opposed faces of said mounting portion, one said opposed face being separated from the carrying portion and comprising one side of an upwardly open notch, a single attaching member formed as a bolt fitted into said passage, and having an enlarged, flattened head at one end and a threaded portion at its opposite end, said head having a breadth slightly less than the length of a wall slot, and a thickness slightly less than the breadth of said wall slot, means for holding said bolt so the head, in use, will present its broadest measure perpendicularly to the length of said slot, and for preventing rotation of said bolt in said passage, the bolt having sufficient length to present said head at a distance outside the other of said opposite faces, while presenting at least part of the threaded portion in said notch, and a nut rotatably mounted on said threaded portion and disposed in said notch for permitting access to said nut by means of a tool so that the nut can be loosened, said bracket including a support projecting vetically from said mounting portion so that the support, when attached to a cable or the like, can be pulled on and rotated remotedly, to orient the head of the bolt so that the bracket will fall from the slot in which it is normally mounted when used to support scaffolding material.

2. The attaching device according to claim 1 in which the mounting portion is located about level with said cantilever arm and includes an angled member attached below the arm, and in said support member comprising an inclined bar attached to the outward end of the arm, and to a stay depending from said angled member.

3. The attaching device according to claim 1 in which said mounting portion is located above said cantilever arm.

4. The structure as claimed in claim 1, in which said side faces of the head, turned toward the wall are chamfered.

* * * * *